US006120142A

United States Patent [19]

Eltgen et al.

[11] Patent Number: 6,120,142

[45] Date of Patent: Sep. 19, 2000

[54] HIGH-SPEED PRINTER AND THE USES OF SUCH A PRINTER

[75] Inventors: Jean-Jacques Eltgen, Danjoutin; Jean Mourier, Savigny sur Orge, both of France

[73] Assignee: Nipson S.A., Belfort, France

[21] Appl. No.: 08/863,716

[22] Filed: May 27, 1997

Related U.S. Application Data

[63] Continuation of application No. 08/361,325, Dec. 21, 1994, abandoned.

[30] Foreign Application Priority Data

Dec. 21, 1993 [FR] France ..... 93.15388

[51] Int. Cl.[7] ..... B41J 2/01

[52] U.S. Cl. ..... 347/104; 355/24; 399/384; 242/615.12; 242/612.21

[58] Field of Search ..... 347/16, 101, 104, 347/121, 123, 125, 115, 43, 102; 355/24; 399/384; 242/615, 615.12, 615.21

[56] References Cited

U.S. PATENT DOCUMENTS

| | | | |
|---|---|---|---|
| 4,208,666 | 6/1980 | Paranjpe | 347/101 |
| 4,410,897 | 10/1983 | Moriguchi et al. | 355/24 |
| 4,591,884 | 5/1986 | Miyamoto et al. | 347/153 |
| 4,706,099 | 11/1987 | Suzuki | 346/136 |
| 4,788,563 | 11/1988 | Omo et al. | 347/14 |
| 5,179,417 | 1/1993 | Sugaya et al. | 355/319 |
| 5,220,346 | 6/1993 | Carreira et al. . | |
| 5,260,760 | 11/1993 | Takemura et al. | 347/123 |
| 5,410,384 | 4/1995 | Wachtler | 355/319 |
| 5,428,384 | 6/1995 | Richtsmeier et al. | 347/12 |
| 5,546,178 | 8/1996 | Manzer et al. . | |
| 5,568,245 | 10/1996 | Ferber et al. . | |

FOREIGN PATENT DOCUMENTS

| | | | |
|---|---|---|---|
| 0026890 | 9/1980 | European Pat. Off. . | |
| 4110139 | 10/1919 | Germany . | |
| 3232875 | 9/1982 | Germany . | |
| 4213245 | 10/1992 | Germany . | |
| 57-82069 | 5/1982 | Japan | 347/104 |

OTHER PUBLICATIONS

Patent Abstracts of Japan, vol. 10, No. 299 (M–524) (2355) Oct. 11, 1986 & JP A–61 112 667 (Fuji Xerox Co. Ltd) May 30, 1986.

JEE Journal of Electronic Engineering, vol. 28, No. 293, May 1991, Tokyo, JP XP000228797, Ohta and Tagashira "Large Thermal Print Heads Capture Attention in Plotter, Fax Fields".

*Primary Examiner*—John Barlow
*Assistant Examiner*—Craig A. Hallacher
*Attorney, Agent, or Firm*—Miles & Stockbridge P.C; Edward J. Kondracki

[57] ABSTRACT

The present invention relates to a printer with a single printing motor and a single non-contact heating element characterized in that it includes a printing width and a paper path width greater than that of a double web width between 18.5" (46.99 cm) and 20.5" (52.07 cm), and selective control of the writing heads. The writing heads are controlled either in order to use them in a single group to print a centered double-width web, or to use them in two groups of heads to concomitantly print two single-width webs separated by a margin. Both groups of heads or each group of heads can be supplied with one color of ink.

26 Claims, 14 Drawing Sheets

HIGH-SPEED PRINTER AND THE USES OF SUCH A PRINTER

This application is a continuation of application Ser. No. 08/361,325, filed Dec. 21, 1994, now abandoned.

BACKGROUND OF THE INVENTION

Field of the Invention

The present invention relates to a high-speed printer and the uses of such a printer.

In recent years, printer manufacturers have proposed systems for endless printing of a paper web which allow two-color or two-sided printing.

One known system utilizes two machines in tandem, one for printing in black, the other for printing in blue. The paper web passed directly from one machine to the other, generally under a false floor. The disadvantage of such a technique is the necessity for mobilizing two printers even when the portion of the job requiring two colors is relatively small. Technically, the existence of a long paper loop between the exit of one machine and the entrance into the other prevents the fine registering of both colors, particularly if the paper web is not taut.

More recently, approaches for two-sided printing have been proposed which also use two printers in tandem, but which are disposed along axes at 90° so as to allow the paper web to be turned over by a bar at 45°. The paper may or may not be taut, since there are no excessive requirements for registering both sides in the case of two-sided printing. This approach also has the economic disadvantage of requiring two separate machines. Still, it must be noted that the associated additional cost is more justified than in the case of two-color printing due to the resultant savings in paper (also a factor of two). On the other hand, the "L" configuration consumes floor space and does not integrate well with linear installations of presses, such as those encountered in the industrial shops for which two-sided machines are specifically intended. However, an in-line configuration is possible using a more complex system with 3 turner bars, but without reducing the total length of the line. In the case of a simple one-sided operation, one can always return to two separate printers and maintain the same output in terms of pages per minute, but at the cost of relatively clumsy handling.

Another approach to two-sided printing is proposed in U.S. Pat. No. 4,796,066. Two printing motors are placed in series inside a single printer (the double motor approach). This architecture allows the sharing of certain functions common to both motors, hence a lower cost. However, in the case of simple one-sided printing, one of the motors remains unused and the output in pages per minute is divided in half.

SUMMARY OF THE INVENTION

The object of the present invention is to reduce the disadvantages of the prior art by proposing a printer with a single high-speed magnetographic printing motor which makes it possible to print a paper web of normal width on both sides, or to print a paper web of double width on one side, or to print a paper web of normal width in two colors.

This object is attained in that the high-speed printer has a single printing motor and a single non-contact heating element for one printing width and a paper path width greater than that of a double-width web between 18.5" and 20.5" (46.99 cm and 52.07 cm), and selective control of the writing heads, either in order to use them in a single group to print one centered double-width web, or to use them in two groups of heads to concomitantly print two double-width webs separated by a margin; both groups of heads or each group of heads can be supplied with one color of ink.

In another characteristic, the selective control of the heads for printing a pattern from each group of heads onto a single web takes into account the spatial displacement produced by a double-web collator device with two turner bars.

In another characteristic, the printer includes a device for returning a single-width web, printed on one side with a first color of ink by a first group of heads, to the second group of heads without turning it over, in order to allow two-color printing.

In another characteristic, the printer includes a device for returning a single-width web, printed on one side with one color C1 by the first group of heads supplied with the same color of ink, to the second group of heads while turning it over, in order to allow two-sided printing with the same color.

In another characteristic, the selective control of the groups of heads is effected in such a way as to take into account the spatial displacement produced by the returning device.

Another object is to propose a use of printers for two-color or one-sided printing to effect four-color printing on the front side. This object is attained in that two two-color printers are associated in series, with the second printer printing on a first side using the second group of heads, and the device which returns the web without turning it over assures the orientation of the web exiting from the second group of heads of the second printer toward the first group of heads of the second printer disposed on the left side of the second printer.

A second object is to propose a use of the printer according to the invention to allow two-color printing on the front and back sides of a single-width web.

This object is attained in that two two-sided printers are associated in series; the second printer prints the second color of the two-color pattern on the back side of the single-width web using the second group of heads, and the device in the second printer for returning the web without turning it over assures the orientation of the web exiting from the group of heads situated on the right side of the second printer toward the group of heads situated on the left side of the second printer in order to effect printing of the pattern in the second color on the front side of the web.

In another characteristic, each group of heads or both groups of heads are supplied with one color of ink.

Another object is to propose a use which allows two-sided printing of a double-width web or of two single-width webs.

This object is attained in that two printers are associated in series, the two single-width webs or the double-width web exiting from the first printer being turned over by a turner device before being fed into the second printer.

Another object is to propose a use of the printer to effect one-sided, two-color printing of a web and two-sided, one-color printing of a web using different colors on the front and back sides.

This object is attained in that two printers with different colors of ink are associated in series, and the single-width web exiting from the left path of the printer is turned over by a turner device before being fed into the left path of the second printer to be printed with a different color of ink.

Another object is to propose a use of the printer which allows a web to be printed on the front side in two colors and allows a second web to be printed on the front and/or the back side with the same color.

This object is attained in that two printers, the second of which is supplied with two different colors of ink and each of which is associated with a group of heads, are associated in series; the web exiting from the left path of the first printer is turned over in a turner device in order to be fed into the left path corresponding to the first group of heads of the second printer supplied with the same color of ink as the first printer, while the web on the right exiting from the first printer returns directly into the second printer to be printed by the second group of heads of the second printer supplied with the second color.

In another characteristic, two double-width printers are associated in series, and interpolated between them is a device for turning the web over in order to effect two-sided printing of the web.

In another characteristic, two printers with two single-width webs each are associated in series, and a device for turning the web over is inserted between them in order to effect two-sided printing of the web.

In another characteristic, a collating device is disposed at the exit of the second printer with two single-width webs.

BRIEF DESCRIPTION OF DRAWINGS

Other characteristics and advantages of the present invention will become more apparent from a reading of the following description in conjunction with the appended drawings, in which.

DESCRIPTION OF THE PREFERRED EMBODIMENTS

Figure 1:
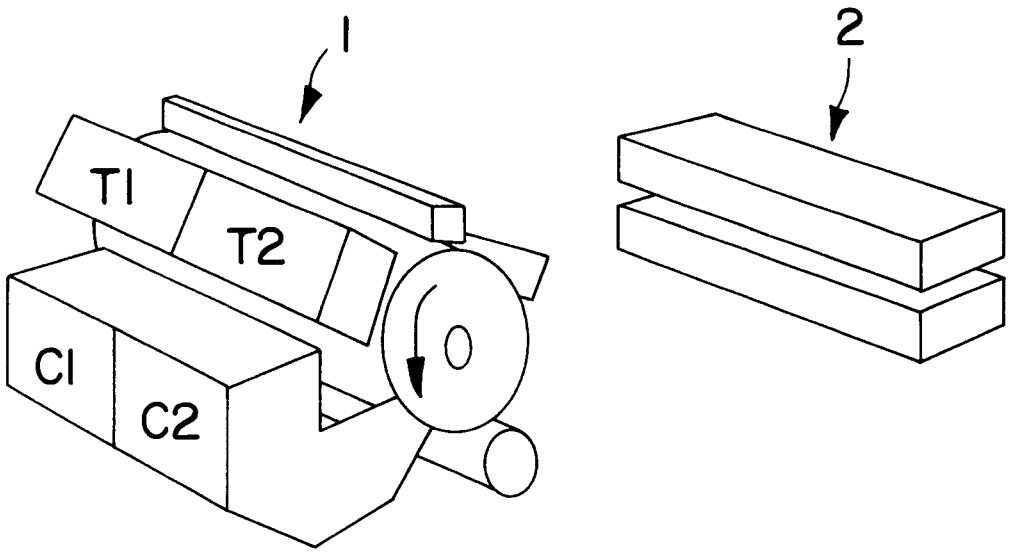
FIG. 1 shows the skeleton diagram of the large magnetographic motor and of the single non-contact heating element which constitute the printer according to the invention.

The invention shown in FIG. 1 is constituted by a printing motor, for example a single magnetographic motor of substantial width (1) and a single non-contact heating element (2). Preferably, the printing motor should have a total paper path width which is oversized relative to the conventional double-width motor, and preferably this width would have to be greater than or equal to 18.5", and preferably with a value set at 20.5", as will be seen below.

While referring to a magnetographic motor by way of example, the invention also applies to any other motor, no matter whether the technology be electrophotographic (laser or LED), ionographic, thermal, ink jet, etc.

Figure 2:
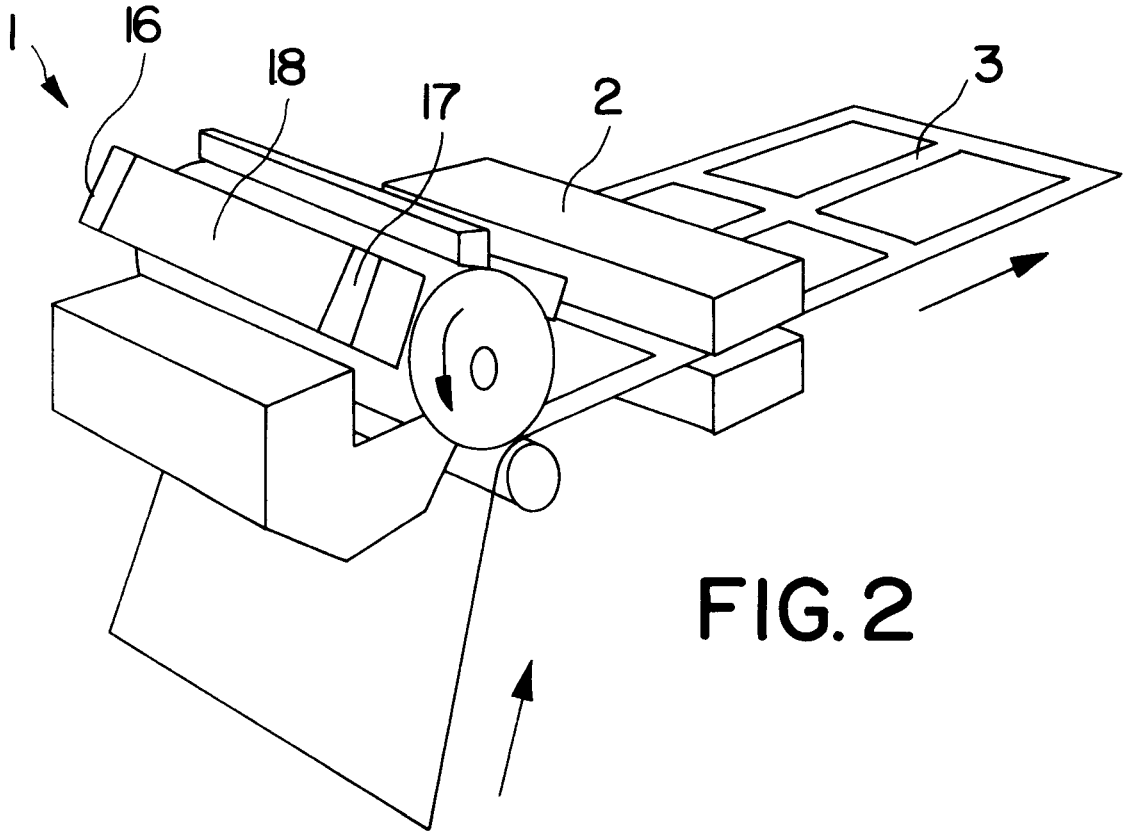
FIG. 2 shows the use of the printer with one double-width paper web.
Figure 17:
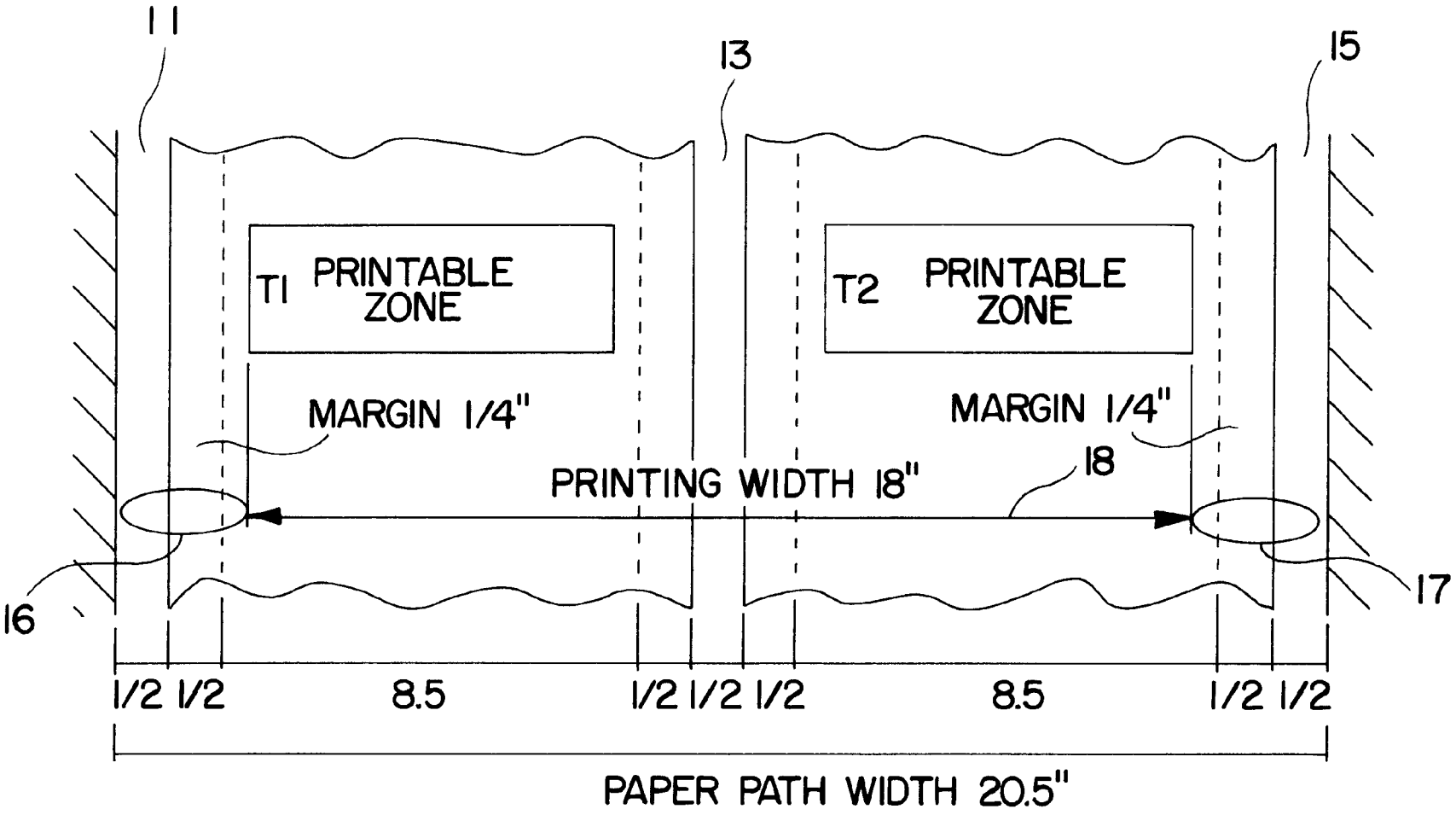
FIG. 17 shows the possible paper path widths and printing widths for the printer according to FIG. 1.

This printing motor will include an assembly of writing heads that can function as a single group with a width which corresponds to a double-width web, as will be seen in FIG. 2, or even as two groups of independent heads, each of which corresponds to the width of a single-width paper web, each group of heads being able to be associated with a supply of different colors of ink C1, C2. It must be noted that the number of writing heads depends on a number of print positions dictated by the density of dots and the width of the printing. Thus, the writing heads must cover a width which corresponds to a double-width web, represented by reference numeral 18 in FIG. 17, and must be able to be selectively controlled as two groups of independent heads with an intermediate zone 13, FIG. 17, which is not printed when the printer is used with a supply of single-width paper web.

FIG. 2 shows the printing motor used in a conventional way with a double-width paper web, and in this case the two groups of writing heads T1, T2 are selected in order to print in the zone 18, and the zones 16 and 17 of the writing heads correspond to the zones situated at the two ends of the printing device which are not used because they are superfluous in the case in question, where there is only one double-width web.

Figure 3:
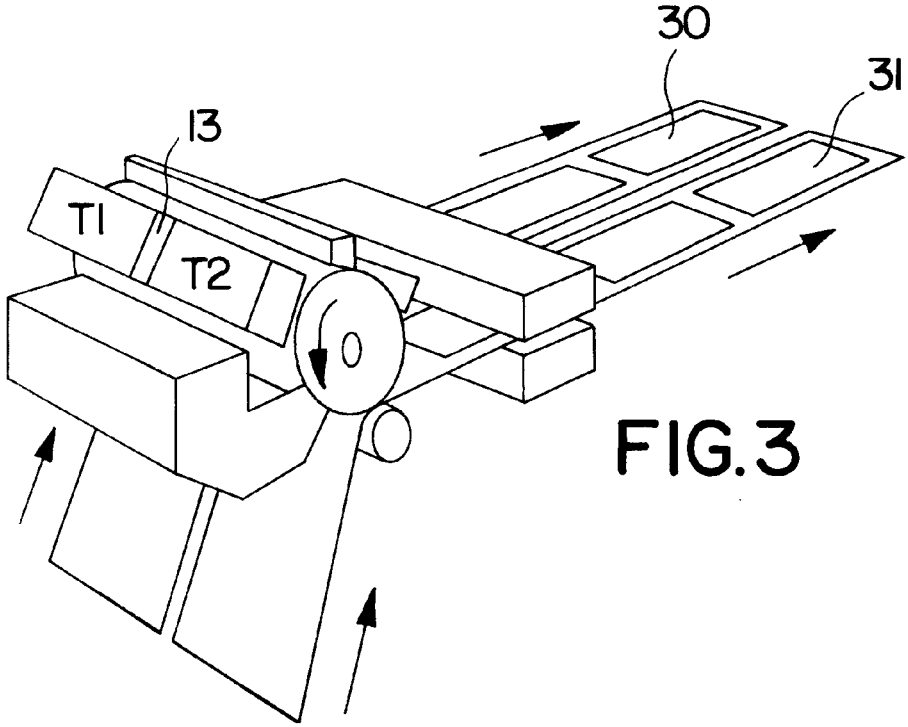
FIG. 3 shows the use of the printer with two single-width paper webs.

FIG. 3 shows the same motor used to print two single-width paper webs separated by a margin. In this usage, the writing heads are controlled as two groups of independently selectable heads T1, T2 separated by an area of unused writing heads 13, which delimits the margin between the two webs. In this case, for this type of use, the paper path (FIG. 17) must be a minimum of 18.5" (46.99 cm) wide to allow the passage of the two 8.5" (21.59 cm) webs and the possibility of having two margins of 0.5" (1.27 cm) at the edges of the paper paths, and a margin of 0.5" (1.27 cm) between the two webs. If, on the contrary, it is a matter of continuous support by means of lateral carriage tapes, the paper webs in the 8.5" (21.59 cm) format will necessitate a paper path width of at least 20.5" (52.07 cm), which breaks down as follows: two times 8.5" (21.59 cm) for the pages proper, 4 times 0.5" (1.27 cm) for the two pairs of lateral carriage tapes, 2 times 0.5 " (1.27 cm) with regard to the edge of the paper path and 0.5" (1.27 cm) for the margin between the two webs. The advantage of such a printer is that it equally offers the possibility of printing double-width or single-width webs using the same printer. This can constitute an inventive step insofar as it thus eliminates the need for a downstream finishing operation for separating two single-width webs originally printed as a double-width web, and insofar as it is possible to operate at a high speed. Moreover, the two single-width webs, because they are both equipped with two lateral drive strips or carriage tapes, can be used directly on other conventional finishing apparatuses, which would not be the case with two half-webs obtained from a single double-width web cut down the middle, each of which would have only one lateral carriage tape and, moreover, situated on different sides.

Figure 4:
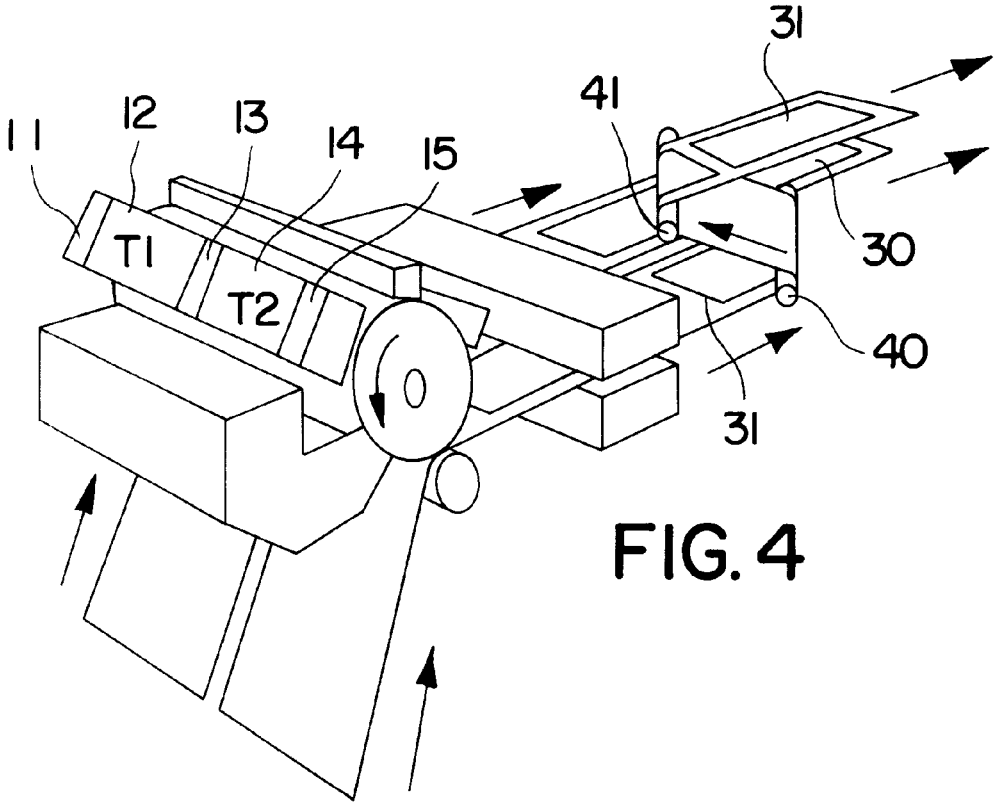
FIG. 4 the use of the printer to effect parallel one-sided printing with collation by translation of the web.

FIG. 4 shows the use of the printer according to the invention for parallel one-sided printing of two single-width paper webs 30, 31 with the aid of two groups of selectively controlled heads T1, T2. The second web 31 which circulates via the right path of the printer is translated by a translation device constituted by a first turner bar 40 and a second turner bar 41 so as to collate the two webs 30 and 31. Each of the printing heads T1, T2 is controlled with a well defined displacement in order to allow temporary compensation for the spatial displacement resulting from the translation system with two bars. The possibility of working on taut webs inside the printer with the collation thus obtained allows excellent control of the register.

Economically, due to the sharing of nearly all of the ancillary functions of the printer, the cost of the collating function is greatly reduced relative to that in the prior art, which is generally constituted by as many customized printers as there are webs to be laid on top of one another.

Furthermore, in the solution of the invention, the speed expressed in pages per unit of time remains exactly the same.

Figure 5:
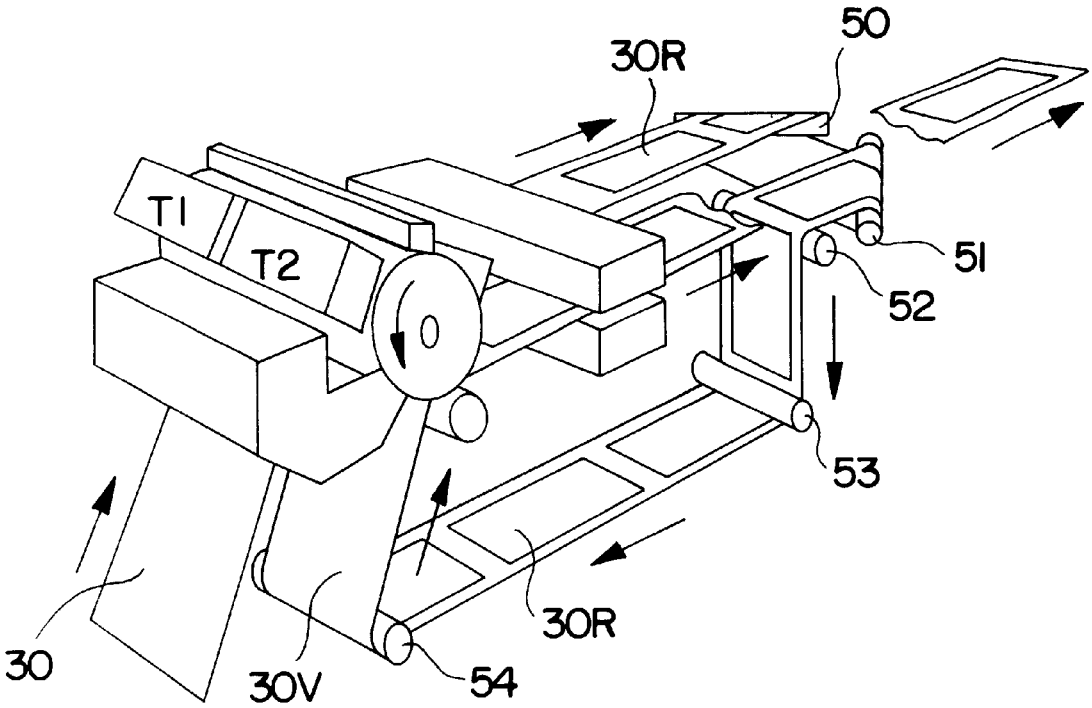
FIG. 5 shows a use of the printer to effect two-sided, one-color printing.

FIG. 5 shows how the printer of the invention can easily be used for the two-sided printing of a single-width web by associating with the printer, which is controlled in accordance with two groups of printing heads, a device for turning the web over twice and reversing its direction of movement, constituted, by way of an illustrative but non-limitative example, by a first turner bar 50 which leads the web 30R exiting from the left path of the printer to pass underneath it at a right angle, and a second turner bar 51 which leads the web to return parallel to and in the opposite direction from the right path. A roller 52 then turns the direction of the web downward, and a second roller 53 again changes the direction of the printing web so that it is displaced parallel to the path. Finally a last roller 54 makes it possible to lead the web 30 to enter the second path of the printer situated on the right, in order to allow printing by the second group of heads T2 on the back side 30V of the web, which having been printed on its back side exits on the right-hand part of the printer. Here again, the use of a properly determined displacement between the controls of the heads in the two halves of the writing station makes it possible to guarantee the register, even more so because the web can be pulled taut. In relation to the prior art, the proposed printer allows extremely flexible utilization without any change in the speed of production of pages.

Figure 6:
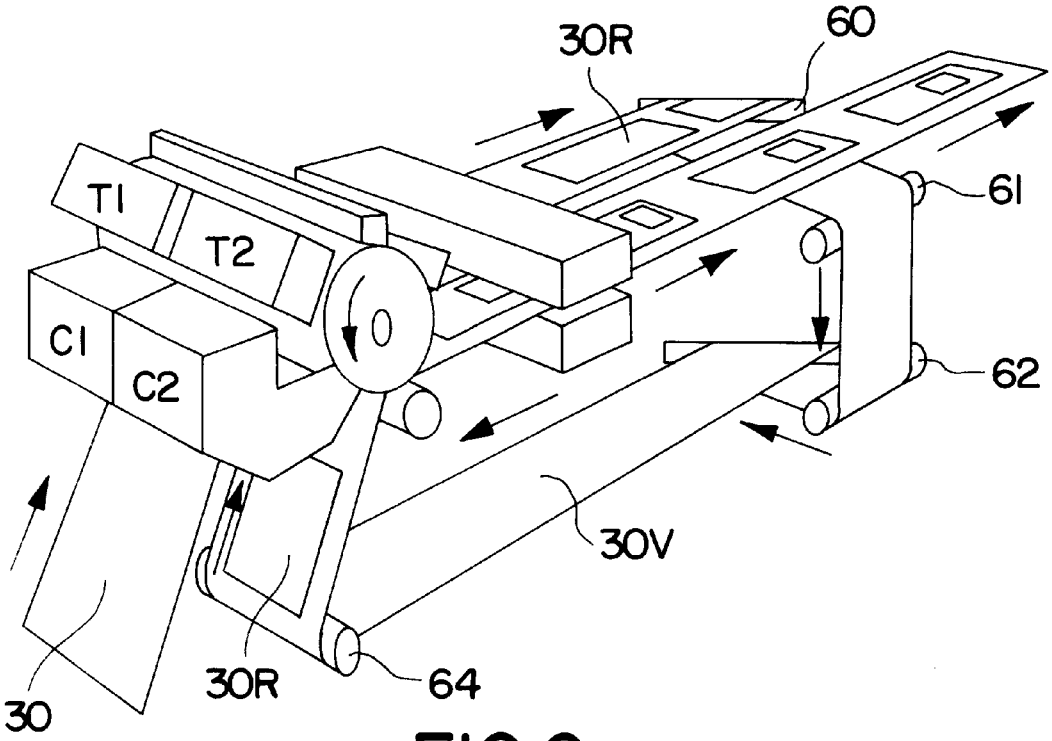
FIG. 6 shows the skeleton diagram of the use of the printer to effect two-color printing on the front side.

Finally, in the case of the use of the printer for two-color printing, the invention can be used as shown in FIG. 6 by associating with each group of writing heads T1, T2 a respective supply of a different color of ink C1, C2. The printer is then fed with a single-width web which returns via the left path of the printer to pass under the group of heads T1, and after having passed through a device for returning it without turning it over, the web is again printed by the second group of heads T2 of the printer which itself is supplied with the second color of ink C2. In this case of utilization, the inking duct of the printing motor is partitioned down the middle and provisions have been made to supply each of the two half-ducts thus obtained independently. In this utilization, the speed expressed in pages per unit of time is, of course, cut in half, but the pages are not the same, in the sense that two-color printing, when it is commercially necessary, constitutes a significant added value which justifies decreasing the speed. The device for returning the web without turning it over is constituted, by way of an illustrative but non-limitative example, by a first turning bar 60 for leading the paper web from the left path at right angles with respect to the directions of the printer path. Then a downward return bar 61 directs this web vertically, a return bar 62 returns it to a horizontal position in the opposite direction running from right to left, and another turning bar 63 repositions the web parallel to the right path and underneath it, heading toward the second printing group T2. Finally a last bar 64 changes the direction of the web to lead its front side toward the second group of printing heads.

Figure 7:
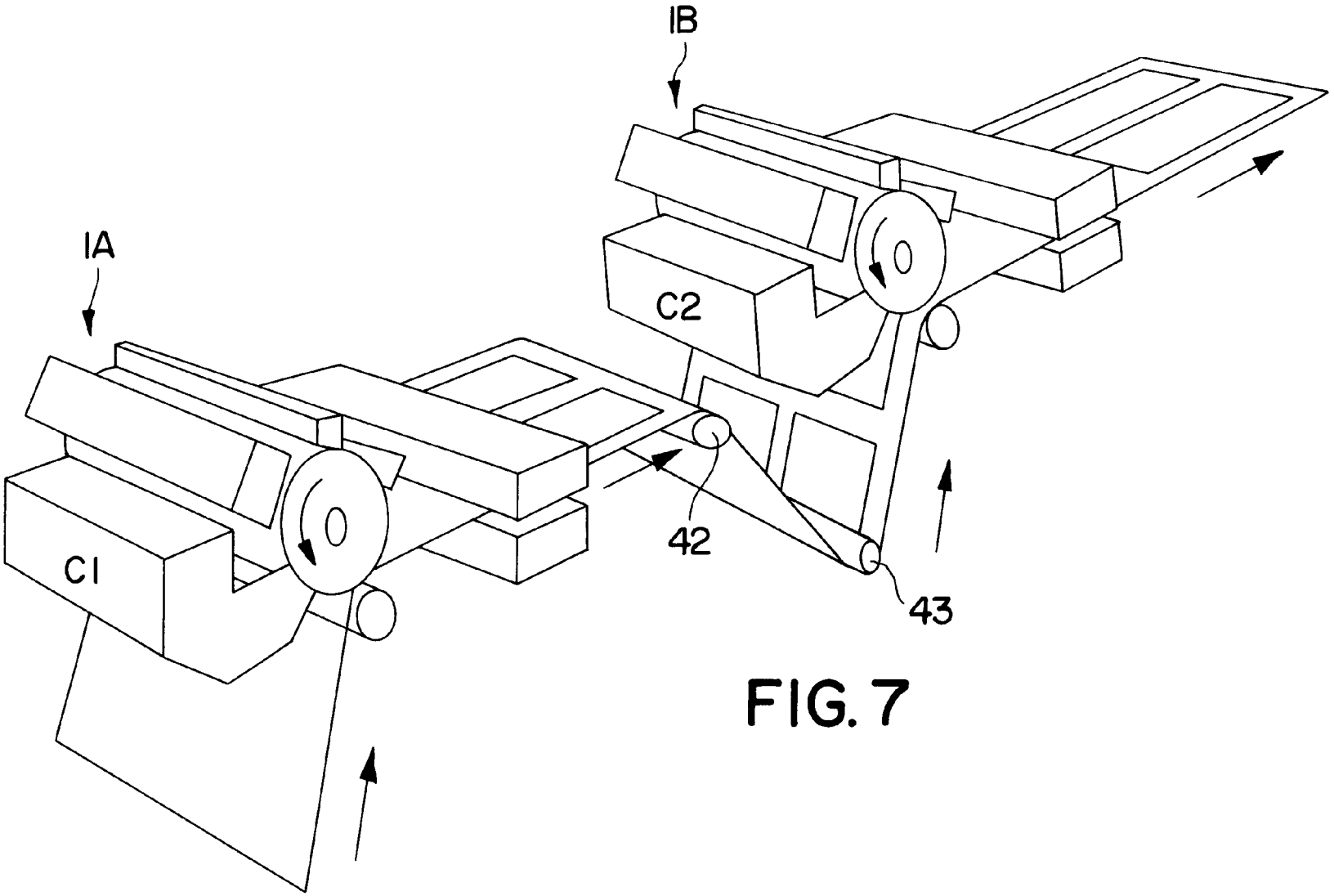
FIG. 7 shows the use of two printers according to the invention to effect large-width one-sided printing.

The use of two printing motors makes it possible to simultaneously offer two-sided printing and/or two-color printing where the known approaches would have necessitated four printing motors. Thus FIG. 7 shows how two printers of the preceding type placed in line make it possible to print two colors onto the same double-width paper web by simply interposing, between the two printing motors 1A, 1B, a roller for downward return 42 and a roller for return 43 toward the entrance to the second printing motor.

Figure 8:
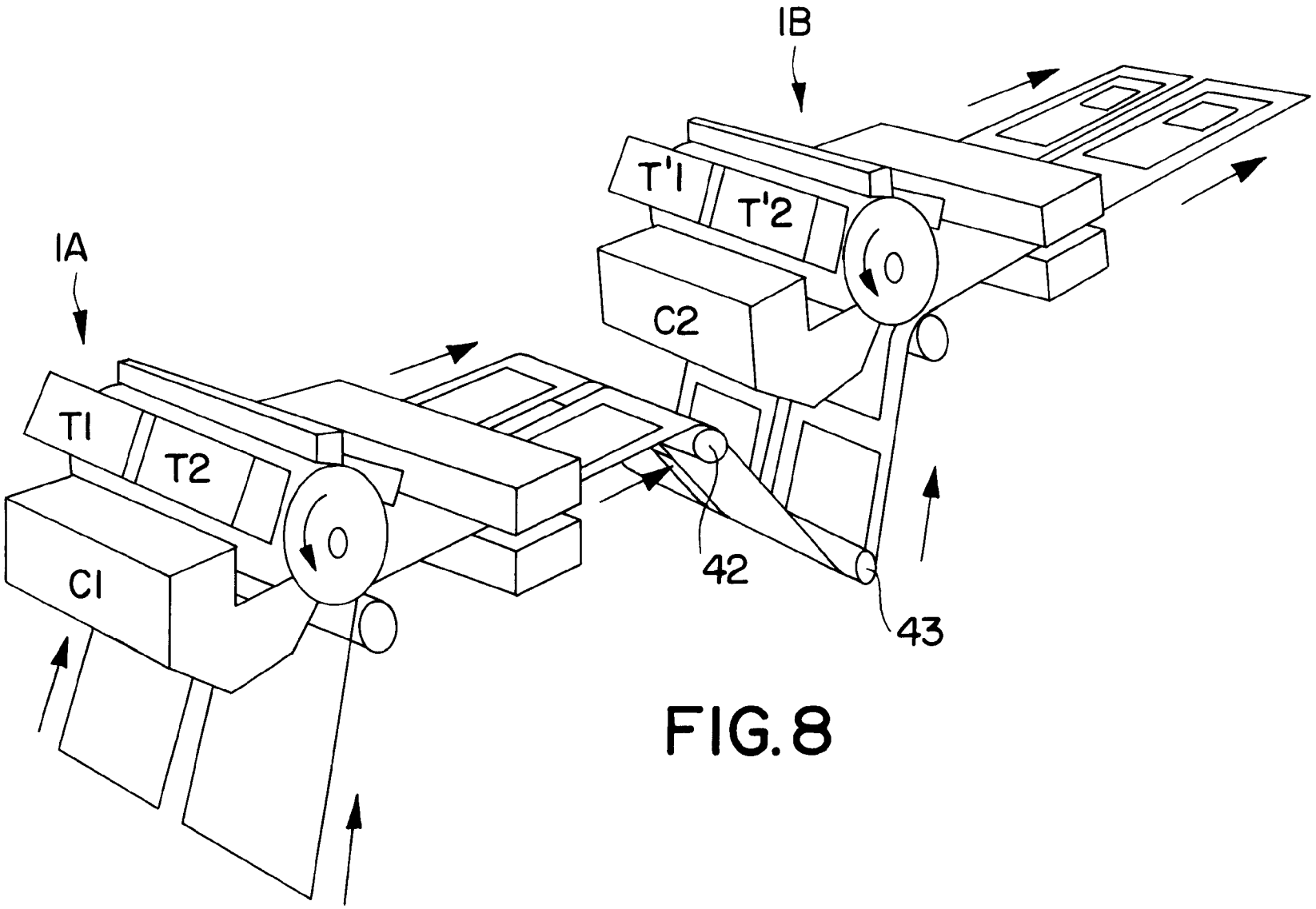
FIG. 8 shows the use of two printers according to the invention to effect parallel one-sided printing in two colors on the front sides of two single-width paper webs.
Figure 9:
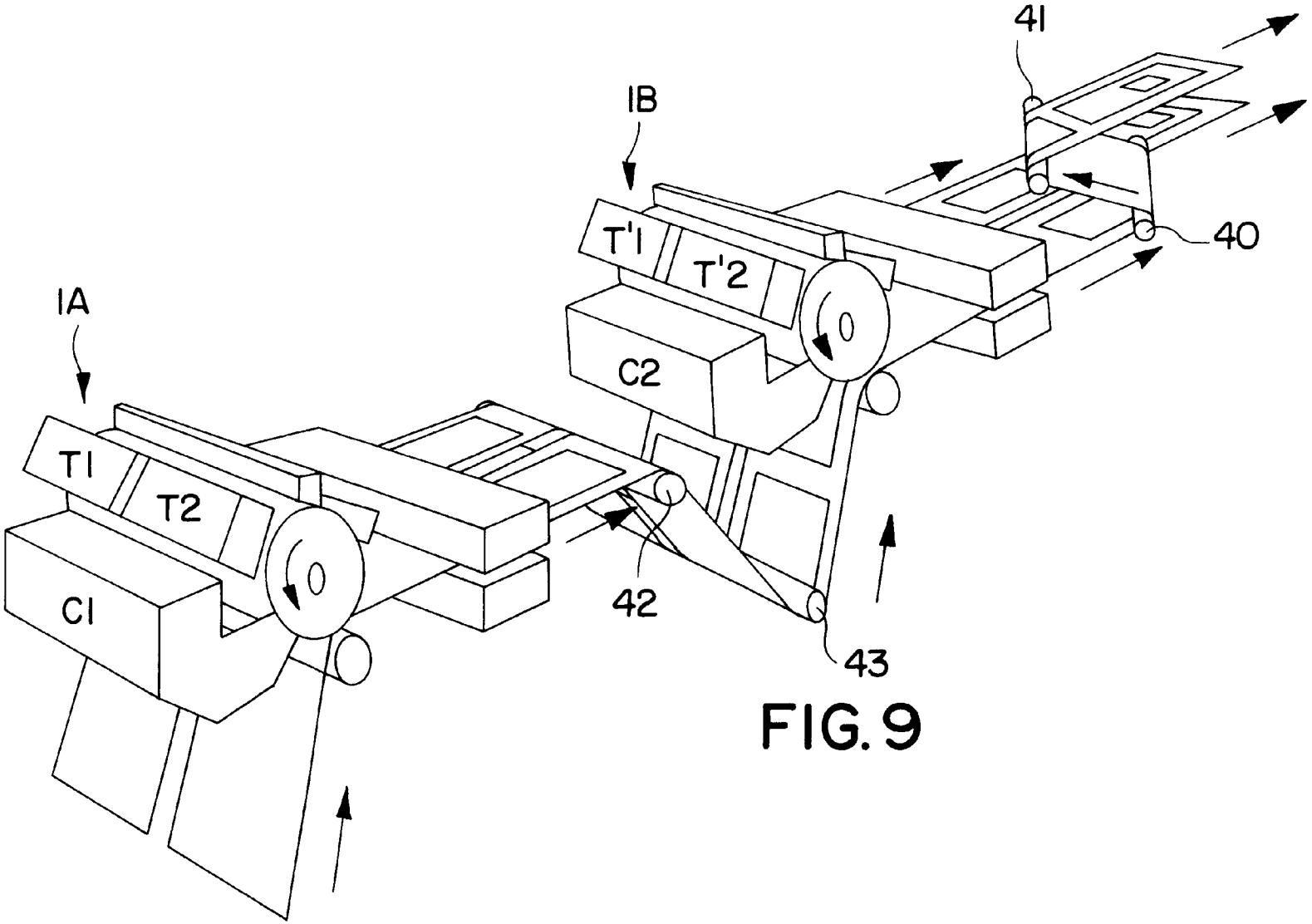
FIG. 9 shows the use of two printers according to the invention to effect parallel one-sided printing in two colors of two single-width paper webs with collation of the two webs.

This same printer constituted by two printing motors 1A, 1B, on the condition that each of the two groups of heads T1, T2, T'1, T'2 are selectively controlled and each of the motors is supplied with different colors of ink, will allow one-sided printing of two single-width paper webs with two colors on the front side as shown in FIG. 8. Likewise, the same printer using two printing motors 1A and 1B will allow parallel printing of two single-width paper webs with two colors on the front side and the collation of the two webs with the aide of a collation device constituted by turner rollers 40, 41 as shown in FIG. 9.

Figure 10:
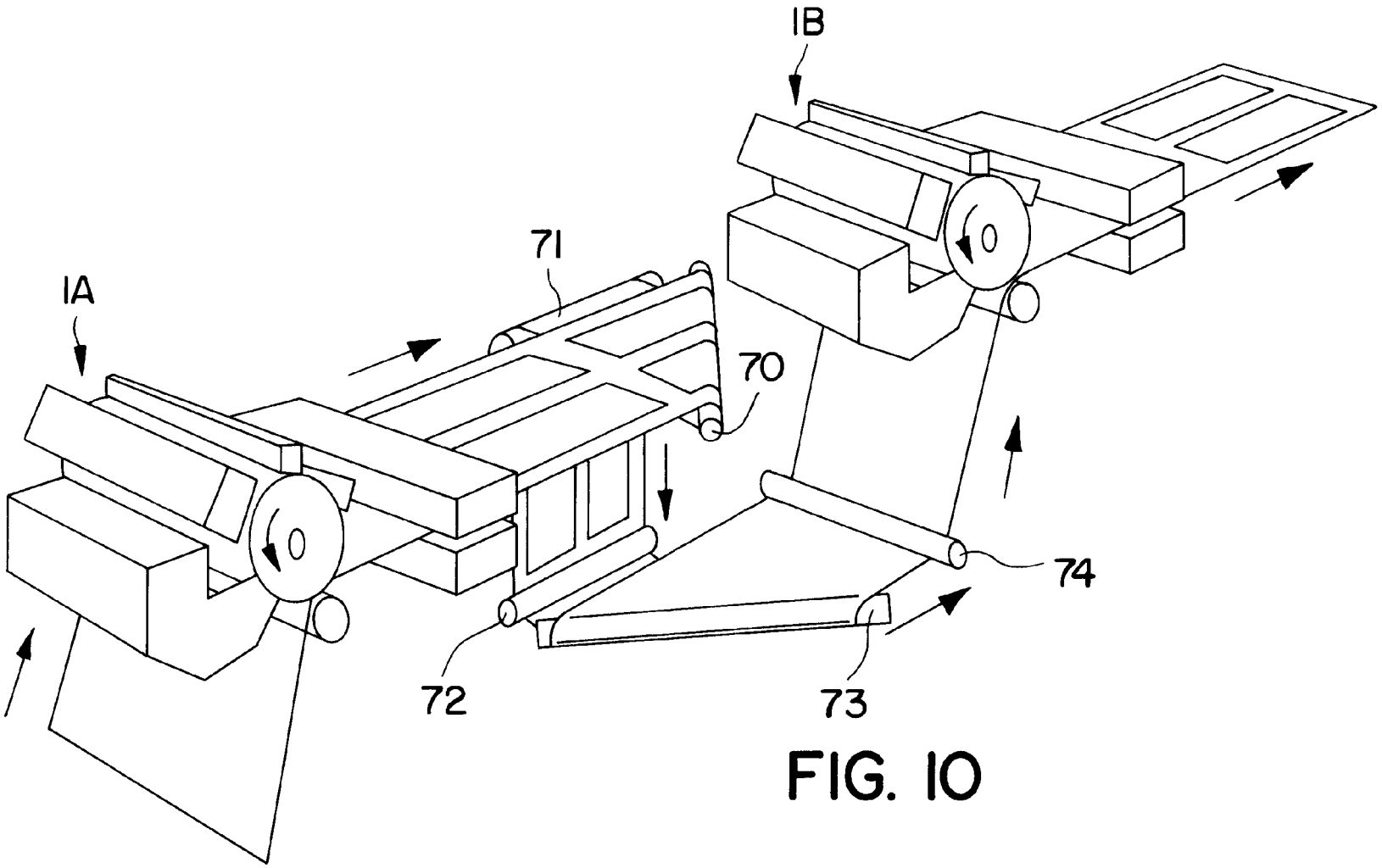
FIG. 10 shows the use of two printers according to the invention to effect two-sided one-color printing of a double-width paper web.

FIG. 10 shows how the two printing motors 1A, 1B described above allow two-sided printing of a double-width web by interposing between the two motors a device for turning the web over constituted, by way of an illustrative but non-limitative example, by a turner bar 70, a reversing rod 71 which orients the web downward, a reversing rod 72 which orients the web horizontally, a second turner bar 73, and a reversing rod 74 which orients the web toward the entrance to the second motor 1B.

Figure 11:
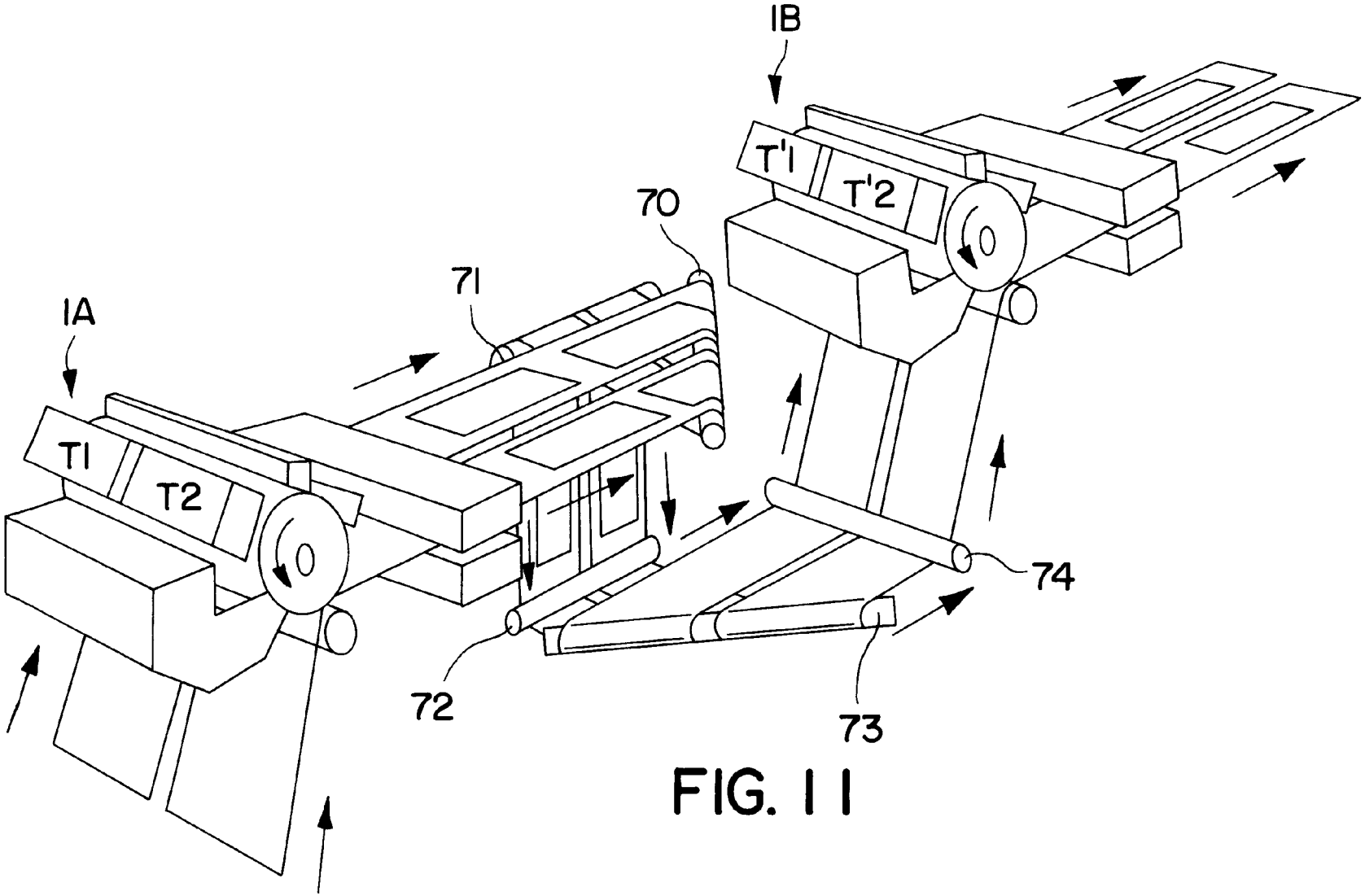
FIG. 11 shows the use of two printers according to the invention to effect two-sided one-color printing of two single-width paper webs.

FIG. 11 shows the use of the same architecture for parallel two-sided one-color printing of two single-width paper webs. In this case the invention has the same practical advantage as that already cited in the case of two-color printing.

Figure 12:
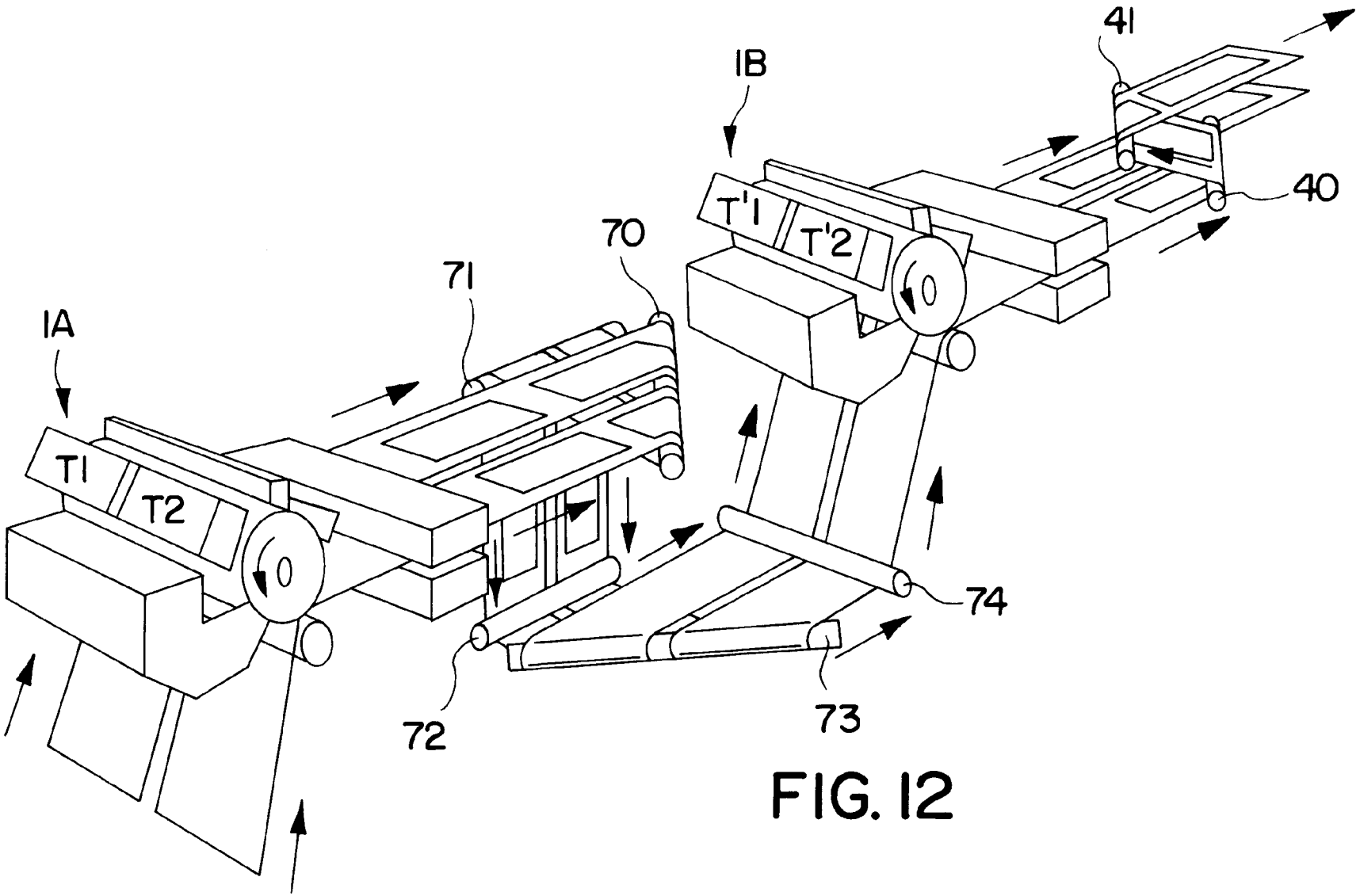
FIG. 12 shows the use of two printers according to the invention to effect parallel two-sided one-color printing of two single-width paper webs with collation.

FIG. 12 shows how, by adding a device such as that in FIG. 11, a lateral translation device constituted by two 45° turner bars 40, 41, it is possible to obtain a collator for two webs, each web being customized both on the front side and on the back side.

Figure 13:
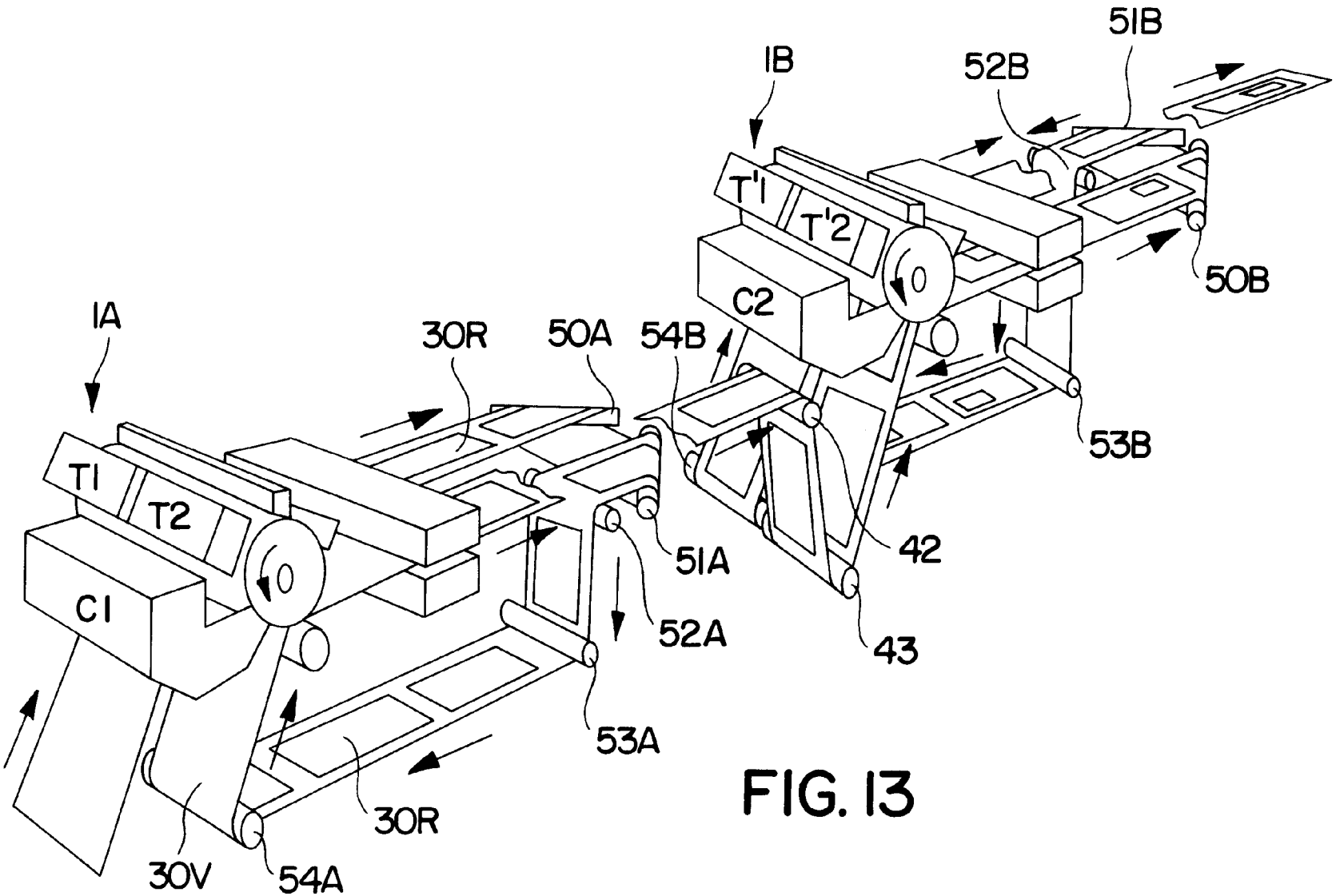
FIG. 13 shows the use of two printers according to the invention to effect two-sided two-color printing of one single-width paper web with two colors on the front side and on the back side.

FIG. 13 shows in schematic form how two printers of the type described in FIG. 5 can be adapted to allow two-color, two-sided printing of a single-width web. A first printer of the type in FIG. 5 is associated with a second printer of the same type, but in which the incoming and outgoing paths have been reversed. That is, the incoming path of the second printer 1B is formed by the straight line opposite the second group of writing heads T'2 of the second printer, and the device for returning the web and turning it over assures its return, with a turnover, from the right path toward the left path so that the web ends up on its back side facing the first group of heads T'1 situated on the left path of the second printer 1B. In this device the first printing motor 1A is supplied with a color of ink C1 and the second printing motor 1B is supplied with a color of ink C2, and thus the single-width web is printed in two colors C1, C2 on each of its two sides.

Figure 14:
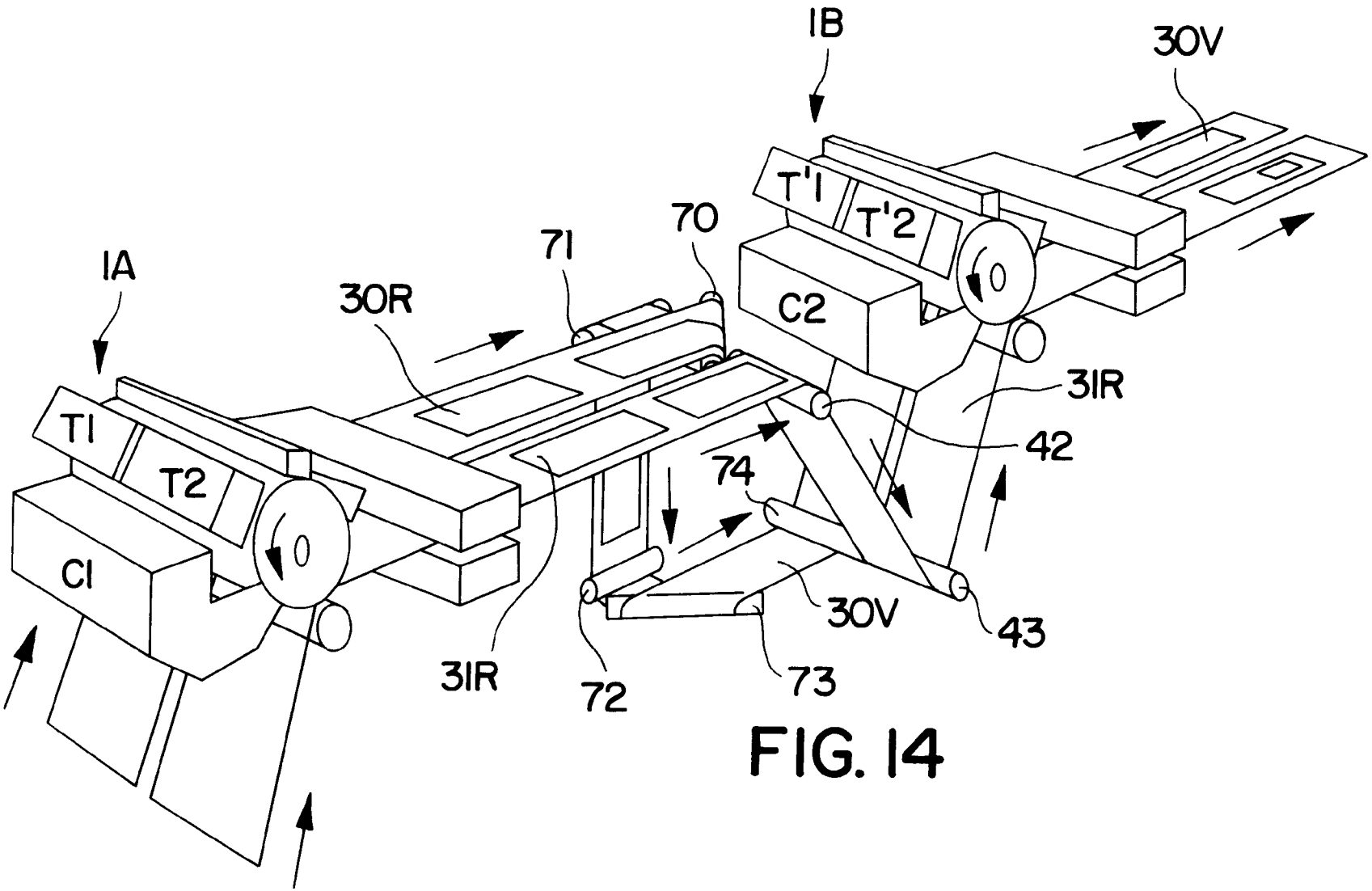
FIG. 14 shows the use of two printers according to the invention to effect one-sided two-color printing, and a two-sided one-color printing using different colors on the front and back sides, of single-width paper webs.

FIG. 14 also illustrates the great versatility offered by the printer of the invention when it is combined with another printer of the same type in order to print simultaneously, in parallel, a single-width web on one side in two colors and a single-width web on two sides, each side of which is in one color, but in a different color from the other side. This involves the use of a first printing motor 1A, in which the groups of heads T1, T2 are supplied with a color of ink C1 and through which two single-width webs 30R, 31R pass, the left web being turned over before being fed into the second printing motor by a conventional turner device constituted, by way of an illustrative but non-limitative example, by a turner bar 70, a bar for downward return 71, a bar for horizontal return 72, a second turner bar 73 and a bar for return 74 toward the entrance to the left path of the second printer 1B. For the right path, the web 31R simply passes out of the first printer 1A over one reversing bar 42 and under a second reversing bar 43 to enter the right path of the second printer 1B whose two groups of heads T'1 and T'2 are supplied with a different color of ink C2.

Figure 15:
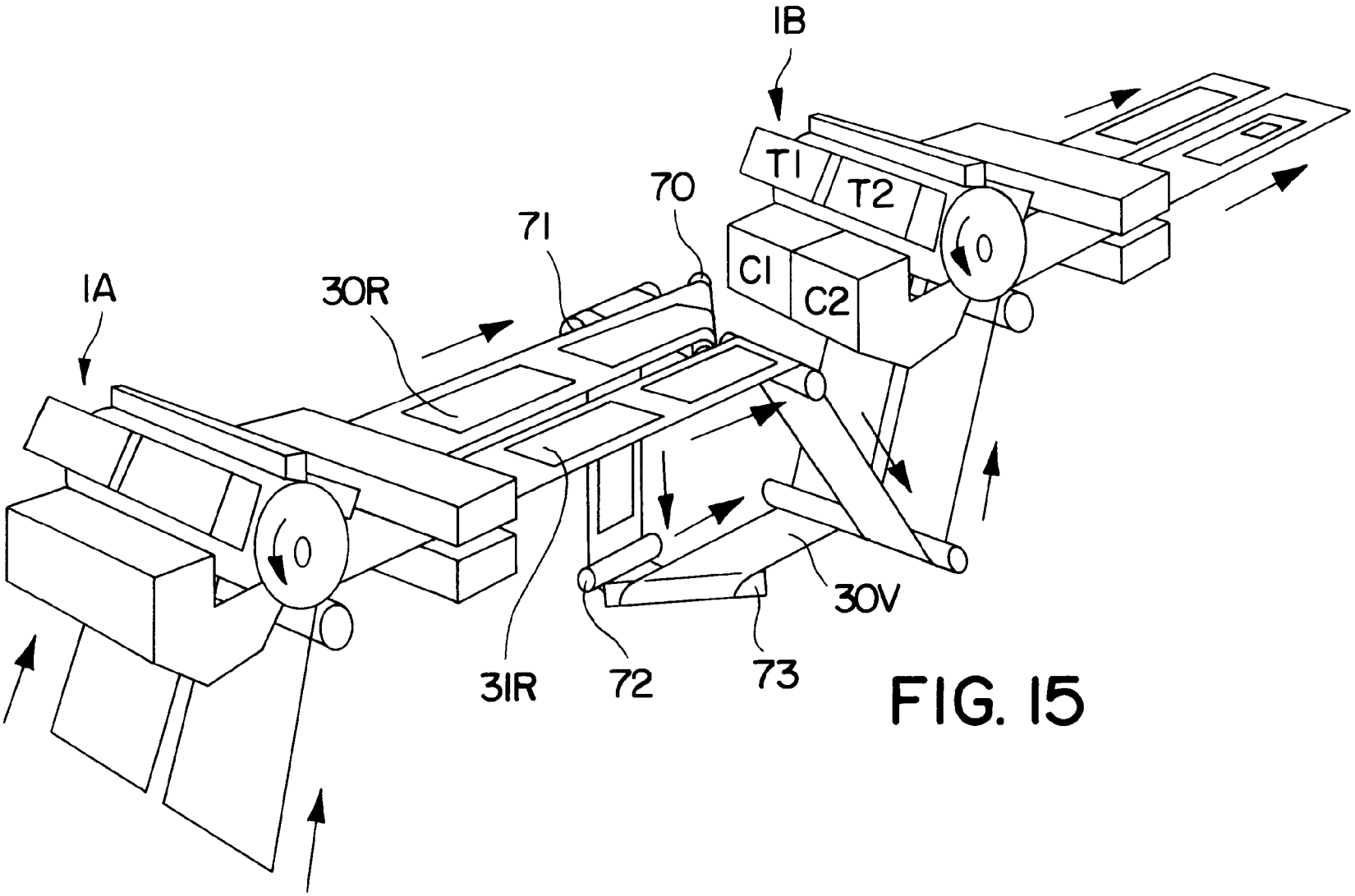
FIG. 15 shows the use of two printers according to the invention to effect one-sided two-color printing of one single-width paper web, and a two-sided one-color printing of the other single-width paper web with the same color on the front and back sides.

The variant in FIG. 15 corresponds to the architecture of FIG. 14, simply with a double inking duct for the second printing motor, through which the group of heads T'1 is supplied with one color of ink C1 which is identical to the ink supplied to the first printing motor 1A, and the second group of heads T'2 of the second printing motor 1B is supplied with a different color of ink C2.

With this version, the same color is obtained on both sides of the two-sided web printed on the left path of the printer, and the other web is always two-colored on the front side.

Figure 16:
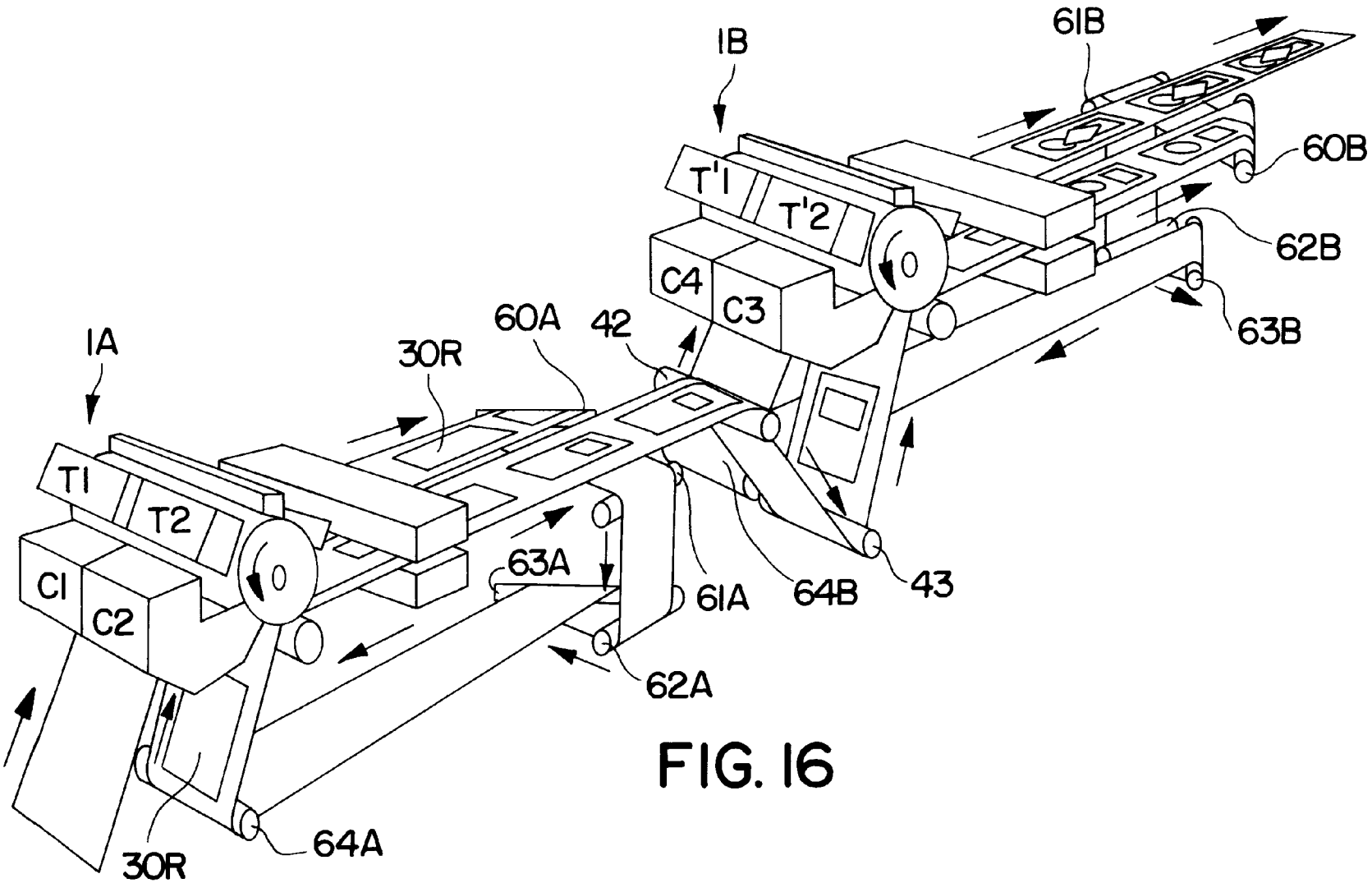
FIG. 16 shows the use of two printers according to the invention to effect four-color printing on the front side of one single-width paper web.

Finally, FIG. 16 shows an architecture using two printing motors of the type in FIG. 6, with a partitioned inking duct which allows endless printing of four-color images from the two colors of ink C1, C2 contained in the inking ducts of the first motor 1A and the two other colors of ink C3, C4 located in the second motor 1B. The ink C1 serves to supply the first group of writing heads T1 of the first motor 1A, and the ink C2 the second group of heads T2 of the first motor 1A, which receives the web after it has passed by the first group of heads and the device for returning the web without turning it over. The web exits via the right path of the first motor 1A to enter the right path of the second motor 1B, which will print the front side with a color of ink C3 which supplies the second group T'2 of the second motor 1B. Then the web, after having passed through a device for returning it without turning it over, re-enters the left path of the second motor 1B and the color of ink C4 is printed with the aid of the first group of heads T'2 of the second motor. Thus, it is possible to realize the multiple possibilities offered by this new type of printer motor in combination with the devices for returning a web and turning it over or for returning a web without turning it over, or for collation.

Any modifications within the competence of one skilled in the art are also part of the spirit and scope of the invention.

While the preferred forms and embodiments of the invention have been illustrated and described, it will be apparent to those of ordinary skill in the art that various changes and modifications may be made without deviating from the inventive concepts and spirit of the invention as set forth above, and it is intended by the appended claims to define all such concepts which come within the full scope and true spirit of the invention.

We claim:

1. A printer assembly for printing on a circulating centered double-width web or two single-width webs separated by a gap (13) comprising:

a single printing motor assembly arranged for circulating the web, the web having a web feed path having a width greater than the width of a double-width web, at least one displacement device arranged for acting on the web, at least one pair of heads (T1, T2), each head having a plurality of fixed writing heads arranged for printing patterns on the webs, said patterns being separated from each other by a first spatial displacement in the feed path direction, a single non-contact heating element disposed in the path of travel of the circulating web, and means for selective control of the pairs of heads for alternative operating conditions, a first condition comprising selection of a pair of heads (T1,T2) to print a circulating centered double-width web, a second condition comprising selection of the pair of heads (T1,T2) independently to concomitantly print on the two circulating single-width webs separated by a gap (13), and a third condition comprising selection of the pair of heads (T1,T2) to print overlaved print images on a single width web circulating multiple times past said pairs of heads (T1,T2), means for supplying the selected heads (T1, T2) with at least one color of ink (C1), wherein the means for selective control of the heads in order to print a pattern by each head onto said centered double-width web or said single-width web takes into account a second spatial displacement resulting from the at least one displacement device acting on said centered double-width web or said single-width web.

2. The printer assembly according to claim 1, wherein the displacement device is constituted by a double web collator device having two turner bars and wherein the means for selective control of the heads is adapted for printing a pattern by means of each single group of heads onto a single web and takes into account the second spatial displacement produced by the double-web collator device with two turner bars (40, 41; FIG. 4).

3. The printer assembly according to claim 1, wherein the displacement device is constituted by a return device for the return without turnover (60 through 64; FIG. 6) of a single-width web printed on one side in a first color of ink (C1; FIG. 6) by a first single group of heads (T1) toward a second group of heads (T2) supplied with another color of ink (C2), in order to allow two-color printing on a same side of said web.

4. The printer assembly according to claim 1, wherein the displacement device is constituted by a return device for a return, with turnover (50 through 54; FIG. 5), of a single-width web printed on one side in one color (C1, FIG. 6) by the first group of heads (T1) toward the second group of heads (T2) supplied with ink of the same color (C1), in order to allow two-sided printing.

5. The printer assembly according to claim 1, including a first and a second printer associated in series, the first printer being disposed such that the two single-width webs (FIG. 11) or the double-width web (FIG. 10) exit from the first printer (1A) and are turned over by a turner device (70 through 74) before being fed into the second printer.

6. The printer assembly of claim 1 wherein said at least one displacement device comprises a displacement device operative in one of a first, second, third, or fourth print configurations, wherein said first print configuration includes said displacement device configured for printing on the circulating centered double-width web, said second print configuration includes said displacement device configured for printing said single-width web fed multiple times through the printer assembly, said third print configuration includes said displacement device configured to displace first and second single-width webs separated by a gap, said displacement operatively causing said first single-width web to be displaced in relation to said second single width web, and said fourth print configuration includes said displacement device configured to displace two single width webs separated by a gap, each of said two single width webs each having opposing first and second printed sides, said displacement operatively causing one or both said opposing first and second printed sides to be reversed with respect to said single printer assembly.

7. A printer assembly for printing on a circulating centered double-width web or two single-width webs separated by a gap (13) comprising:

a single printing motor assembly arranged for circulating the web, the web having a web feed path having a width greater than the width of a double-width web, at least one displacement device arranged for acting on the web, at least one pair of heads (T1, T2), each head having a plurality of fixed writing heads arranged for printing patterns on the webs, said patterns being separated from each other by a first spatial displacement in the feed path direction, a single non-contact heating element disposed in the path of travel of the circulating web, and means for selective control of the pairs of heads for alternative operating conditions, a first condition comprising selection of a pair of heads (T1,T2) to print a circulating centered double-width web, a second condition comprising selection of the pair of heads (T1,T2) independently to concomitantly print on the two circulating single-width webs separated by a gap (13), means for supplying the selected heads (T1,T2) with at least one color of ink (C1), wherein the means for selective control of the heads in order to print a pattern by each head onto a same or different web, takes into account a second spatial displacement resulting from the at least one displacement device acting on said same or different web; wherein the displacement device is constituted by a return device for a return without turnover (60 through 64; FIG. 6) of a single-width web printed on one side in a first color of ink (C1; FIG. 6) by a first single group of heads (T1) toward a second group of heads (T2) supplied with another color of ink (C2), in order to allow two-color printing in a same side of said web; and the printer assembly includes a first printer (1A) and a second printer (1B) associated in series for four-color printing on the same side of a single width web, the second printer (1B) using the second group of heads (T'2; FIG. 16) as the first printer and printing on a first side, and the device for returning without turnover (60B through 64B; FIG. 16) disposed to assure the orientation of the web exiting from the second group of heads (T'2) of the second printer toward the first group of heads (T'2) of the second printer disposed on the left side of the second printer so as to print four colors on the same side of a single width web.

8. The printer assembly according to claim 7, wherein each group of heads or both groups of heads are supplied with one color of ink.

9. The printer assembly according to claim 7, wherein the printing motor is the magnetographic type.

10. The printer assembly according to claim 7, wherein the printing motor is the electrophotographic type.

11. The printer assembly according to claim 7, wherein the printing motor is the ionographic type.

12. The printer assembly according to claim 7, wherein the printing motor is the thermal type.

13. The printer assembly according to claim 7, wherein the printing motor is the ink-jet type.

14. The printer assembly according to claim 7, wherein the first motor is a first type and the second motor is another type.

15. A printer assembly for printing on a circulating centered double-width web or two single-width webs separated by a gap (13) comprising:

a single printing motor assembly arranged for circulating the web, the web having a web feed path having a width greater than the width of a double-width web, at least one displacement device arranged for acting on the web, at least one pair of heads (T1, T2), each head having a plurality of fixed writing heads arranged for printing patterns on the webs, said patterns being separated from each other by a first spatial displacement in the feed path direction, a single non-contact heating element disposed in the path of travel of the circulating web, and means for selective control of the pairs of heads for alternative operating conditions, a first condition comprising selection of a pair of heads (T1,T2) to print a circulating centered double-width web, a second condition comprising selection of the pair of heads (T1,T2) independently to concomitantly print on the two circulating single-width webs separated by a gap (13), means for supplying the selected heads (T1, T2) with at least one color of ink (C1), wherein the means for selective control of the heads in order to print a pattern by each head onto a same or different web, takes into account a second spatial displacement resulting from the at least one displacement device acting on said same or different web; wherein the displacement device is constituted by a return device for a return, with turnover (50 through 54; FIG. 5), of a single-width web printed on one side in one color (C1, FIG. 6) by the first group of heads (T1) toward the second group of heads (T2) supplied with ink of the same color (C1), in order to allow two-sided printing; and a first (1A) and a second (1B) two-sided printer associated in series, the second printer (1B) printing the second color (C2) of the two-color pattern on the back side of the single-width web using the second group of heads (T'2), and the device for returning with turnover (50B through 54B; FIG. 13) in the second printer (1B) being disposed to assure the orientation of the web exiting from the group of heads (T'2) situated at the right of the printer toward the group of heads (T'1) situated at the left of the second printer (1B) in order to effect the printing of the pattern in the second color (C1) on a front side of the web.

16. The printer assembly according to claim 15, wherein each group of heads or both groups of heads are supplied with one color of ink.

17. The printer assembly according to claim 15, wherein the printing motor is the magnetographic type.

18. The printer assembly according to claim 15, wherein the printing motor is the electrophotographic type.

19. The printer assembly according to claim 15, wherein the printing motor is the ionographic type.

20. The printer assembly according to claim 15, wherein the printing motor is the thermal type.

21. The printer assembly according to claim 15, wherein the printing motor is the ink-jet type.

22. The printer assembly according to claim 15, wherein the first motor is a first type and the second motor is another type.

23. A printer assembly for printing on a circulating centered double-width web or two single-width webs separated by a gap (13) comprising:

a single printing motor assembly arranged for circulating the web, the web having a web feed path having a width greater than the width of a double-width web, at least one displacement device arranged for acting on the web, at least one pair of heads (T1, T2), each head having a plurality of fixed writing heads arranged for printing patterns on the webs, said patterns being separated from each other by a first spatial displacement in the feed path direction, a single non-contact heating element disposed in the path of travel of the circulating web, and means for selective control of the pairs of heads for multiple operating conditions, a first condition comprising selection of a pair of heads (T1,T2) to print a circulating centered double-width web, a second condition comprising selection of the pair of heads (T1,T2) independently to concomitantly print on the two circulating single-width webs separated by a gap (13), and a third condition comprising selection of the pair of heads (T1,T2) to print overlayed print images on a single width web circulating multiple times past said pairs of heads (T1, T2), means for supplying the selected heads (T1, T2) with at least one color of ink (C1), wherein the means for selective control of the heads in order to print a pattern by each head onto said centered double-width web or said single-width web takes into account a second spatial displacement resulting from the at least one displacement device acting on said centered double-width web or said single-width web; and including a first (1A) and a second printer (1B) printing in series on two single width webs with different colors of ink, and wherein single-width web exiting from a left path under a left group of heads (T1) of the first printer (1A; FIG. 14) is turned over by a turner device (70 through 74; FIG. 14) before being fed into a left path of the second printer (1B) to be printed in a different color of ink by the left group of heads (T1) of the second printer (1B).

24. A printer assembly for printing on a circulating centered double-width web or two single-width webs separated by a gap (13) comprising:

a single printing motor assembly arranged for circulating the web, the web having a web feed path having a width greater than the width of a double-width web, at least one displacement device arranged for acting on the web, at least one pair of heads (T1, T2), each head having a plurality of fixed writing heads arranged for printing patterns on the webs, said patterns being separated from each other by a first spatial displacement in the feed path direction, a single non-contact heating element disposed in the path of travel of the circulating web, and means for selective control of the pairs of heads for multiple operating conditions, a first condition comprising selection of a pair of heads (T1,T2) to print a circulating centered double-width web, a second condition comprising selection of the pair of heads (T1,T2) independently to concomitantly print on the two circulating single-width webs separated by a gap (13), and a third condition comprising selection of the pair of heads (T1,T2) to print overlayed print images on a single width web circulating multiple times past said pairs of heads (T1,T2), means for supplying the selected heads (T1, T2) with at least one color of ink (C1), wherein the means for selective control of the heads in order to print a pattern by each head onto said centered double-width web or said single-width web takes into account a second spatial displacement resulting from the at least one displacement device acting on said same or different web centered double-width web or said single-width web; and including a first (1A) and a second (1B) printer associated in series for printing on a two single width web, the second printer (1B; FIG. 15) being supplied with two different colors of ink (C1, C2), and each printer using the heads in two groups of heads (T'1, T'2), and wherein the web exiting via a left path of the first printer is turned over in a turner device (70 through 73; FIG. 15) in order to be fed into a left path corresponding to the first group of heads (T'1) of the second printer (18) which is supplied with the same color of ink (C1) as the first printer (1A), while a right web exiting from the first printer (1A) returns directly into the second printer (1B) to be printed by the second group of heads (T'2) in the second printer (1B) supplied with the second color (C2).

25. A printer assembly for printing on a circulating centered double-width web comprising:

a first and second printing motor assembly each arranged for circulating the web, the web having a web feed path having a width greater than the width of the double-width web, at least one displacement device arranged for acting on the web, at least one pair of heads, each head having a plurality of fixed writing heads arranged for printing patterns on the webs, said patterns being separated from each other by a first spatial displacement in the feed path direction, each of said first and second motor assemblies being associated with a single non-contact heating element disposed in the path of travel of the circulating web, means for selective control of the pairs of heads to print the circulating centered double-width web, and means for supplying the selected heads with at least one color of ink, wherein the means for selective control of the heads in order to print a pattern by each head onto said centered double-width web, takes into account a second spatial displacement resulting from the at least one displacement device acting on.

26. A printer assembly for printing on two circulating single-width webs, comprising:

a first and second printing motor assembly each arranged for circulating the webs, each web having a web feed path having a width greater than the width of the double-width web, at least one displacement device arranged for acting on at least one web, at least one pair of heads, each head having a plurality of fixed writing heads arranged for printing patterns on the two webs, said patterns being separated from each other by a first spatial displacement in the feed path direction, said heads arranged for concomitantly printing on the circulating two single width webs separated by a gap (13), each of said first and second motor assemblies being associated with a single non-contact heating element disposed in the path of travel of the circulating web, means for selective control of the pairs of heads to print a circulating centered double-width web, and means for supplying the selected heads with at least one color of ink, wherein the means for selective control of the heads in order to print a pattern by each head onto said two centered double-width webs, takes into account a second spatial displacement resulting from the at least one displacement device acting on the webs.

* * * * *